United States Patent [19]

Nakamura

[11] Patent Number: 4,748,928

[45] Date of Patent: Jun. 7, 1988

[54] STEERING HANDLE DEVICE FOR JET-PROPELLED SMALL-SIZED BOATS

[76] Inventor: Yukio Nakamura, 3-19, 1-Chome, Tengachayakita, Nishinari-Ku, Osaka-Shi, Osaka-Fu, Japan

[21] Appl. No.: 65,525

[22] Filed: Jun. 23, 1987

[51] Int. Cl.[4] ..... B63H 11/02

[52] U.S. Cl. ..... 114/144 R; 74/479; 114/270

[58] Field of Search ..... 114/144 R, 270; 440/38, 440/53, 40, 63; 74/479, 491, 480 B; 244/234

[56] References Cited

U.S. PATENT DOCUMENTS

| | | | |
|---|---|---|---|
| 3,726,497 | 4/1973 | Gannett et al. | 244/234 |
| 3,826,220 | 7/1974 | Jacobson | 114/270 |
| 4,062,508 | 12/1977 | Stephens et al. | 244/234 |

FOREIGN PATENT DOCUMENTS

| | | |
|---|---|---|
| 50-24519 | 8/1975 | Japan . |
| 51-7910 | 3/1976 | Japan . |
| 53-6237 | 2/1978 | Japan . |
| 53-33352 | 8/1978 | Japan . |
| 54-40636 | 11/1979 | Japan . |
| 59-43355 | 10/1984 | Japan . |

OTHER PUBLICATIONS

Jet Ski Watercraft Parts Catalogue, by Kawasaki Heavy Industries, Ltd., 1984.

*Primary Examiner*—Joseph F. Peters, Jr.

*Assistant Examiner*—Edwin L. Swinehart

*Attorney, Agent, or Firm*—Armstrong, Nikaido, Marmelstein & Kubovcik

[57] ABSTRACT

The invention relates to a steering handle device for jet-propelled small-sized boats on the type in which the operator rides the boat in a standing posture. The invention prevents the operator's body from being twisted around during the turning of the boat to the extent that he is forced to assume an unstable steering posture, and makes it possible to apply the foot pressure resulting from the operator's body weight to the boat body effectively and as desired from the standpoint of human engineering so as to provide the so-called quick steering performance. To this end, the invention provides a steering handle device for jet-propelled small-sized boats, comprising: a base block fixedly installed on the rear upper end of a handle post erected on a boat body, the base block having a pair of handle stays extending integrally therefrom to assume a rearwardly diverging form as seen from above, and handle bars pivotally connected at their respective front ends, by ball joints, to the right and left end regions of a handle bar attaching plate which is pivotally connected to the base block by a vertical shaft, the rear end of each of the handle bars being pivotally connected to the rear end of the associated handle stay by an upright handle grip, the arrangement being such that when the two handle grips are tilted back and forth, the handle bar attaching plate is turned.

3 Claims, 7 Drawing Sheets

STEERING HANDLE DEVICE FOR JET-PROPELLED SMALL-SIZED BOATS

BACKGROUND OF THE INVENTION

Generally, in jet-propelled small-sized boats which freely glide over water surface, a single person rides the boat in a standing posture on the floor deck of the boat with his hands gripping the handle bars to rotate them for steering so as to control a steering cable extending from a handle post via the boat interior to the stern to swing the steering nozzle of the jet propelling device for steering the boat. In such conventional boat, as is clear from FIGS. 7 and 8, a pair of handle bars b, particularly their grip portions c, extending from the rear upper end of the handle post a are arranged in a rearwardly diverging form in a horizontal plane as seen from above.

As a result, when the boat body d is being turned, the operator's body will be twisted around in such a manner that his hands holding the grip portions c are moved sideways; thus, the operator is forced to assume an extremely unstable posture which makes it impossible for him to steer the boat in a smooth stabilized manner.

Further, since his posture with his hands holding the grip portions results in his upper arms being spaced away from his sides, from the standpoint of human engineering the foot pressure resulting from the operator's body weight could not be applied to the boat body d effectively and as desired. Thus, there has been a problem that the boat is inferior in the so-called quick steering performance.

SUMMARY OF THE INVENTION

The present invention has been accomplished to overcome such problems.

Accordingly, an object of the invention is to provide a steering handle device for jet-propelled small-sized boat, comprising a pair of handle grips which are pivotally connected to handle bars and handle stays so that the handle grips can be tilted back and forth, whereby the boat can be stably and lightly steered solely by substantially the wrists of the operator's hands holding the handle grips and hence his posture can be maintained with his upper arms drawn to his sides, so that his body is prevented from being twisted around when the boat is turning.

Another object of the invention is to provide a steering handle device for jet-propelled small-sized boats, wherein said handle grips are upright and pivotally connected to said handle bars and handle stays, whereby the wrists of the operator's hands holding the same are maintained also upright, making it possible to effectively apply his body weight to the boat body without any loss or to smoothly displace his body weight, thus providing improved steering performance such as quick turning.

Other objects of the invention will become more apparent from the following detailed description when taken in conjunction with the accompanying drawings.

DETAILED DESCRIPTION OF THE PREFERRED EMBODIMENTS

Figure 1:
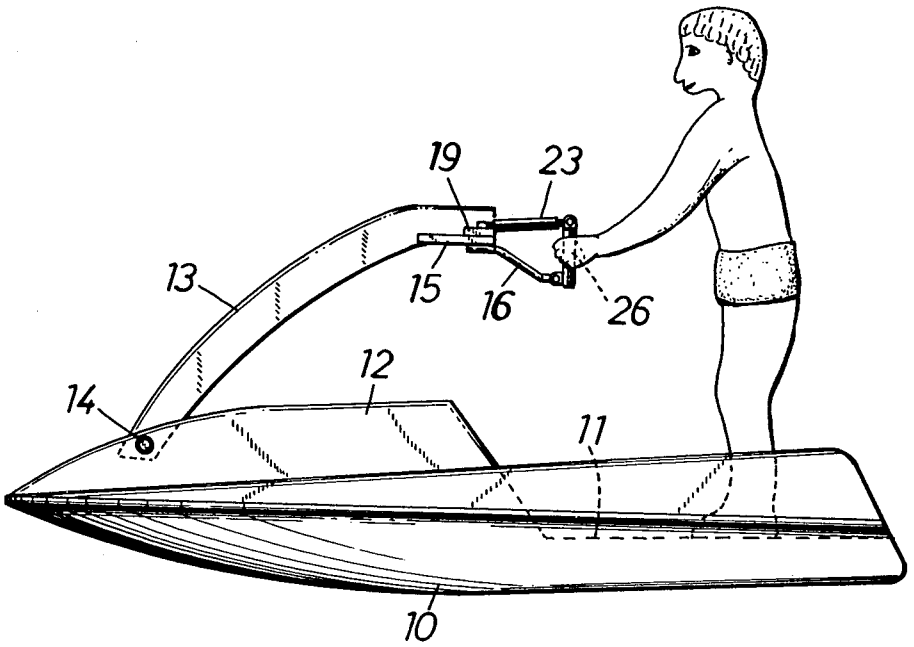
FIG. 1 is a schematic overall side view of a jet-propelled small-sized boat having the present invention applied thereto.
Figure 2:
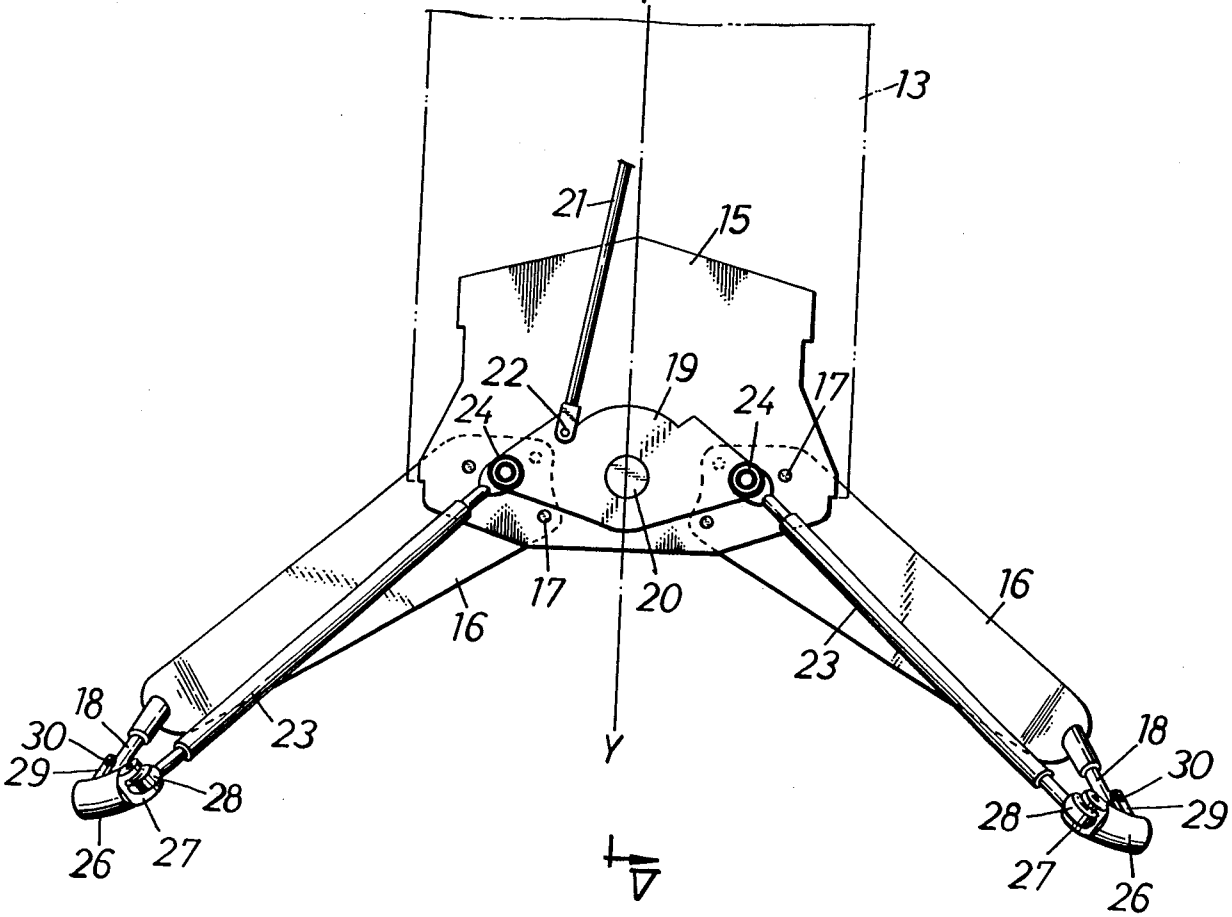
FIG. 2 is an enlarged plan view of a steering bar device extracted for showing.
Figure 3:
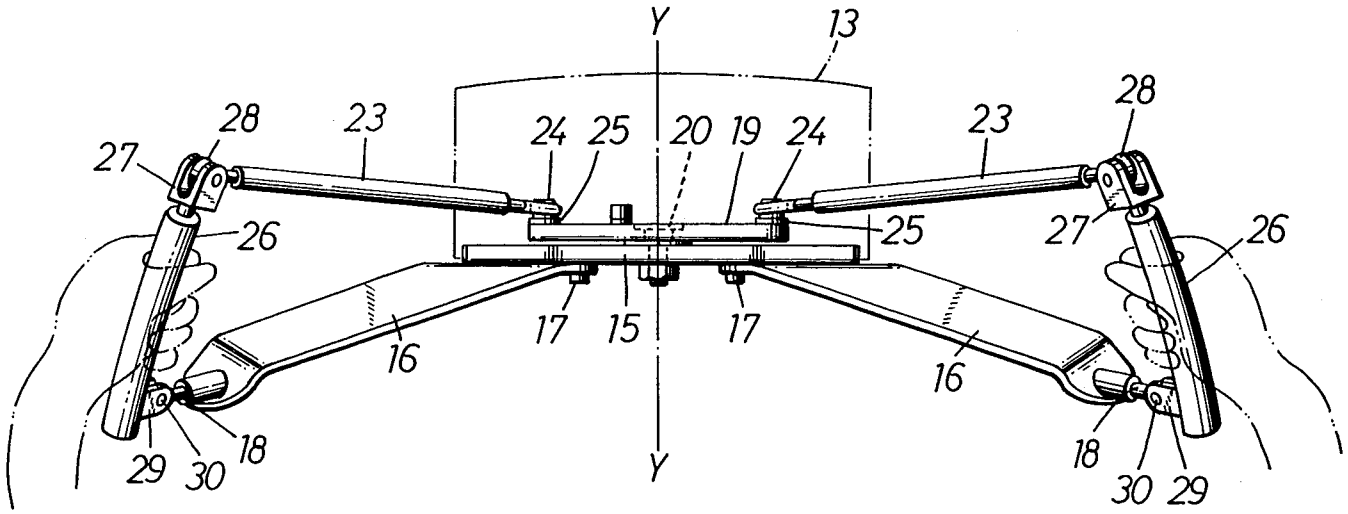
FIGS. 3 and 4 are a rear view and a side view, respectively, of FIG. 2.
Figure 4:
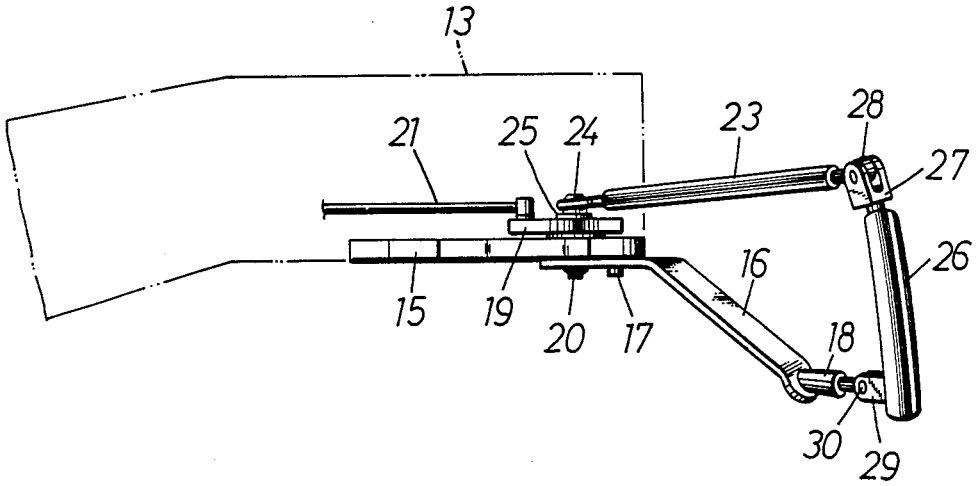
Figure 5:
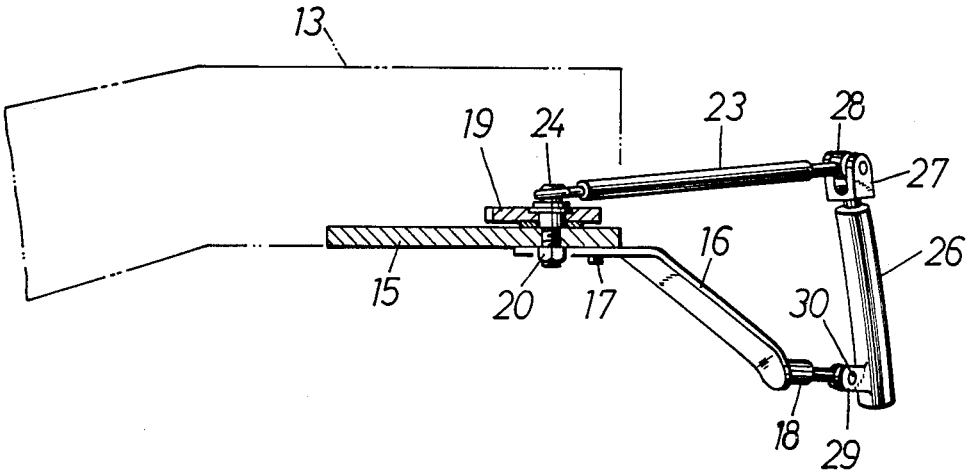
FIG. 5 is a sectional view taken along the line V—V in FIG. 2.

The concrete arrangement of the invention will now be described with reference to the drawings. FIG. 1 schematically shows the whole of a jet-propelled small-sized boat according to the invention. The numeral 10 denotes a boat body of hollow sealed float construction made from fiber reinforced plastic (FRP) or the like, the stern thereof providing a floor deck 11 for an operator to stand on.

The numeral 12 denotes an engine chamber located in the front region, and 13 denotes a handle post tiltably connected to the stern by a horizontal shaft 14. The rear upper end of said handle post overhanging the floor deck 11 has a handle attaching base block 15 fixedly applied to the back thereof.

The base block 15 has the following steering handle device attached thereto.

In FIGS. 2 through 5 showing the steering handle device, 16 denotes a pair of handle stays extending from the rear end of said base block 15 to assume a rearwardly diverging form, with their front ends placed on the lower side of said base block 15 and then integrally fixed thereto by a plurality of bolts 17 or rivets.

In this case, it could be contemplated to replace the bolts 17 or rivets by welding means for fixed installation. However, it is preferable to prepare in advance a large number of holes for receiving the bolts 17 or the like so as to make it possible to change the angle of said stays 16 with respect to the travel center line Y—Y of the boat body 10 or the length of extension (attaching position) of said stays. The numeral 18 denotes connecting elements extending from the respective rear ends of said stays 16.

The numeral 19 denotes a handle bar attaching plate placed on the upper surface of said base block 15 and pivotally connected thereto by a vertical shaft 20, the latter being aligned with the travel central axis Y—Y of the boat body 10. The numeral 21 denotes a steering cable connected at its initial end to said attaching plate 19 at an offset position by a ball joint 22 and at its terminal end to a steering nozzle (not shown) in the stern after passing through the handle post 13 and boat body 1.

The numeral 23 denotes a pair of handle bars extending from the right and left end regions of said attaching plate 19 to assume a rearwardly diverging form, each handle bar preferably including a turnbuckle to adjust its length. The bars 23 are swingably connected at their respective front ends to the attaching plate 19 by ball joints 24. The numeral 25 denotes a collar disposed in a clearance between each ball joint 24 and the attaching plate 19.

The numeral 26 denotes a pair of handle grips, each having a bifurcated connector 27 at its upper end which is pivotally connected to the rear end of said handle bar by a ball joint 28. Further, its bifurcated connector 29 at its lower end is pivotally connected to a connector 18 at he rear end of said handle stay 16 by a substantially horizontal transverse shaft 30 so that it can be tilted back and forth.

In other words, each handle grip 26 is tiltably installed by connecting the handle bar 23 and handle stay 16 which are vertically opposed to each other. The ball joints 24 and 28 positioned at the front and rear ends of each handle bar 23 have their respective axes positioned in substantially orthogonal relationship to each other, as suggested by the illustrated example.

Thus, according to the steering handle bar device constructed in the manner described above, the handle bar attaching plate 19 can be turned around the axis of its vertical shaft 20 to steer the boat body by the operator tilting his wrists while holding the handle grips 26 in the upright state.

Figure 6:
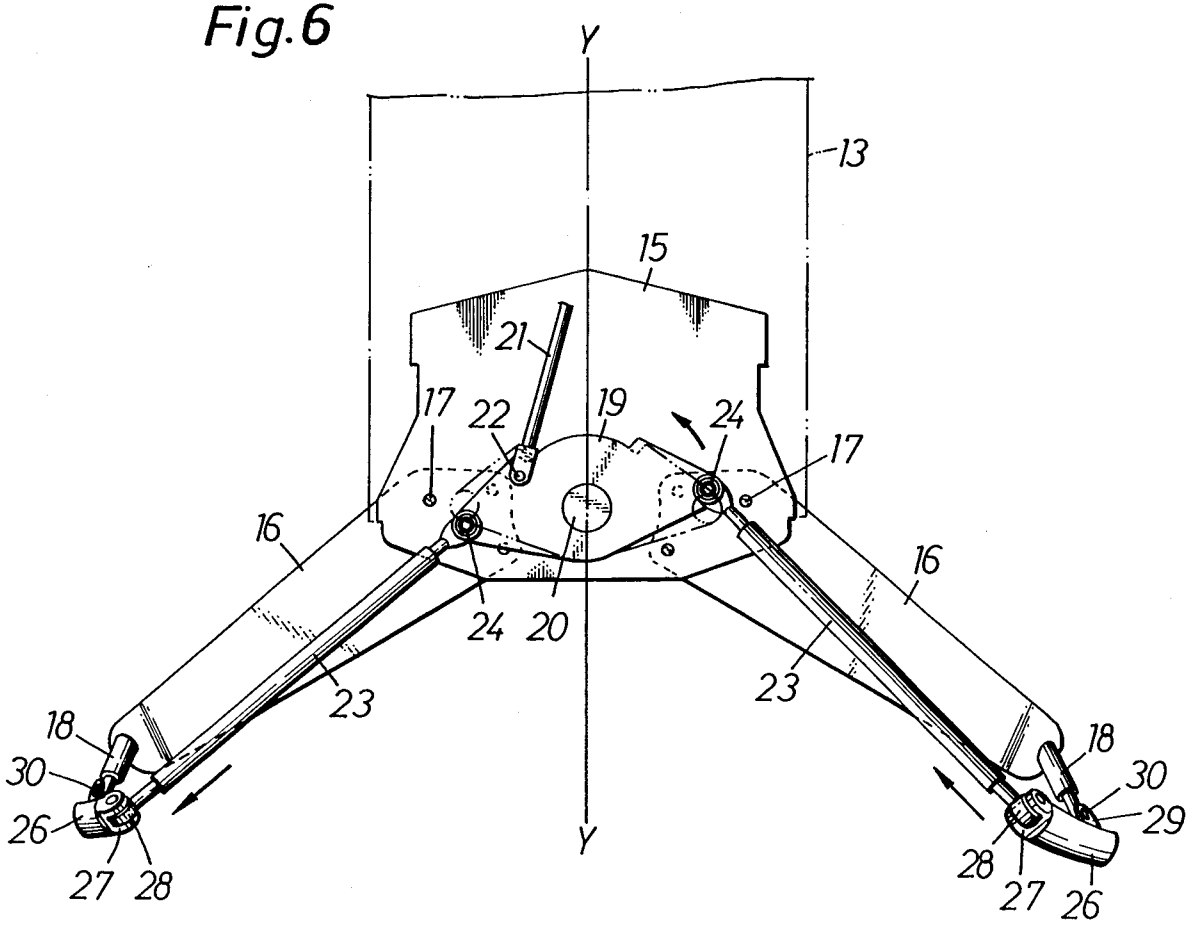
FIG. 6 is a plan view corresponding to FIG. 2, showing the operating state.
Figure 7:
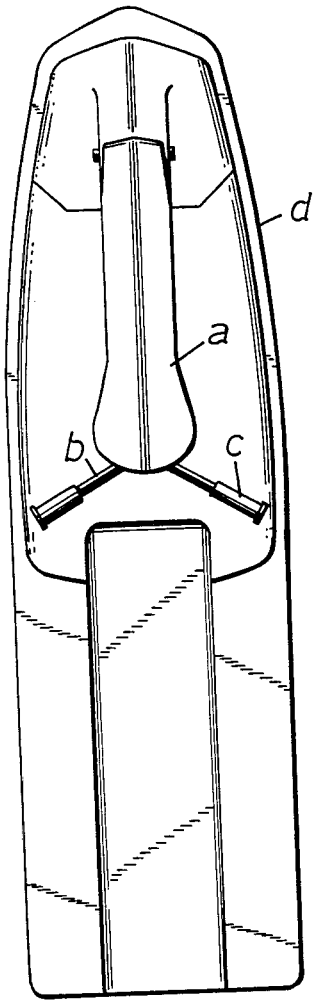
Fig. 7 (Prior Art)
FIG. 7 is a plan view of a conventional steering handle device.
Figure 8:
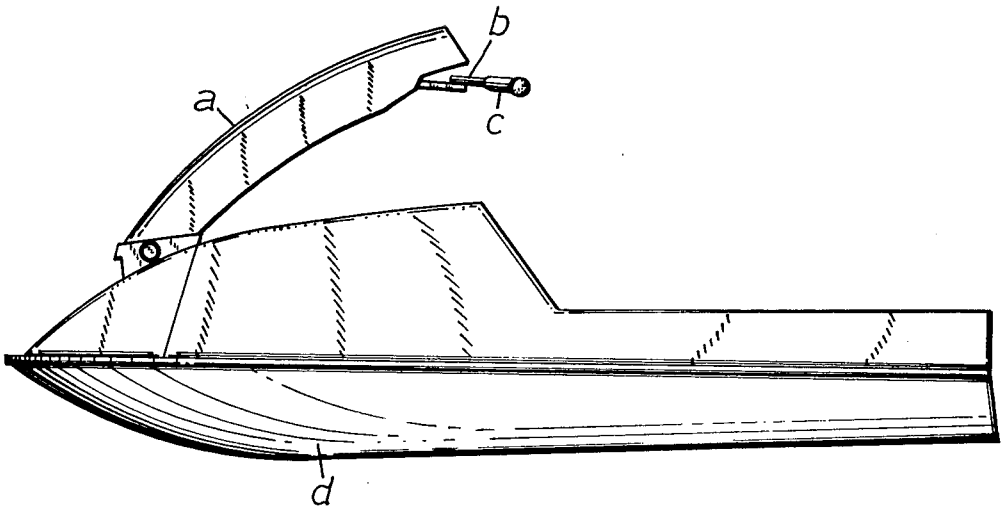
Fig. 8 (Prior Art)
FIG. 8 is a side view of said conventional steering handle device.

That is, as shown in FIG. 6, the pair of handle grips 26 are tiltable around the axes of the transverse shafts 30 at their lower ends; thus, if the operator forwardly tilts the wrist of his right hand holding the handle grip while rearwardly raising the wrist of his left hand, then the right-hand side handle bar 23 moves forward while the left-hand side handle bar 23 moves rearward, thereby turning the handle bar attaching plate 13 counterclockwise, with the result that the boat body 10 is turned in response thereto.

In that case, if it is so arranged that the effective length of the handle bars 23 can be adjusted, as described above, this makes it possible to change the rise angle of the handle grips 26 pivotally connected thereto; thus, the steerability is further improved.

In the illustrated example, the handle bar attaching plate 19 is mounted on the upper surface of the base block 15 and the handle bars 23 are disposed above the level of the handle stays 16; however, such vertical positional relationship may be reversed provided that it is possible to produce said motions.

As has been so far described, a steering handle device for jet-propelled small-sized boats according to the invention comprises:

a base block (15) fixedly installed on the rear upper end of a handle post (13) erected on a boat body (10), said base block (15) having a pair of handle stays (15) extending integrally therefrom to assume a rearwardly diverging form as seen from above, and handle bars (23) pivotally connected at their respective front ends, by ball joints (24), to the right and left end regions of a handle bar attaching plate (19) which is pivotally connected to said base block (15) by a vertical shaft (20), the rear end of each said handle bar (23) being pivotally connected to the rear end of the associated handle stay (16) by an upright handle grip (26), the arrangement being such that when the two handle grips (26) are tilted back and forth, said handle bar attaching plate (19) is turned. Thus, all the problems described at the outset can be overcome.

More particularly, the handle grips 26 are pivotally connected to the handle bars 23 and handle stays 16 so that the handle grips can be tilted back and forth; thus it is possible for the operator to steer the boat body 10 stably and lightly solely by the wrists of his hands holding the grips 26, while assuming a posture such that his upper arms are maintained drawn to his sides; there is no possibility of his body being twisted around during the turning of the boat.

Further, since the wrists of the hands holding the grips 26 are upright, the operator's body weight can be effectively applied to the boat body 10 or smoothly displaced. Therefore, the invention is very useful particularly for use with jet-propelled small-sized boats of the type in which the operator rides the boat in a standing posture.

What is claimed is:

1. A steering handle device for jet-propelled small-sized boats, comprising:

a base block (15) fixedly installed on the rear upper end of a handle post (13) erected on a boat body (10), said base block (15) having a pair of handle stays (16) extending integrally therefrom to assume a rearwardly diverging form as seen from above, and handle bars (23) pivotally connected at their respective front ends, by ball joints (24), to the right and left end regions of a handle bar attaching plate (19) which is pivotally connected to said base block (15) by a vertical shaft (20), the rear end of each said handle bar (23) being pivotally connected to the rear end of the associated handle stay (16) by an upright handle grip (26), the arrangement being such that when the two handle grips (26) are tilted back and forth, said handle bar attaching plate (19) is turned.

2. A steering handle device for jet-propelled small-sized boats as set forth in claim 1, characterized in that each handle grip (26) is pivotally connected at its upper end to the rear end of the associated handle bar (23) by a ball joint (28) and at its lower end to the rear end of the associated handle stay (16) by a transverse shaft (30), so that the handle grip (26) is turnable to be tilted back and forth.

3. A steering handle device for jet-propelled small-sized boats as set forth in claim 1, characterized in that the effective length of the handle bars (23) is adjustable, so that the rise angle of the handle grips (26) pivotally connected thereto can be changed.

* * * * *